United States Patent [19]

Sarasue et al.

[11] Patent Number: 4,566,156

[45] Date of Patent: Jan. 28, 1986

[54] SLIDE FASTENER

[75] Inventors: Hirotaka Sarasue, Ikoma; Yoshitoki Tsubokawa, Kurobe, both of Japan

[73] Assignee: Yoshida Kogyo K. K., Tokyo, Japan

[21] Appl. No.: 517,898

[22] Filed: Jul. 28, 1983

[30] Foreign Application Priority Data

Aug. 2, 1982 [JP] Japan ..... 57-117498[U]

[51] Int. Cl.[4] ..... A44B 19/40

[52] U.S. Cl. ..... 24/398; 24/397

[58] Field of Search ..... 24/397, 398, 396, 381

[56] References Cited

U.S. PATENT DOCUMENTS

| | | | |
|---|---|---|---|
| 2,903,775 | 9/1959 | Johns | 24/205.16 |
| 3,755,993 | 9/1973 | Cote | 24/398 X |
| 3,785,014 | 1/1974 | Canepa | 24/381 |
| 4,167,055 | 9/1979 | Molnar | 24/397 X |
| 4,276,680 | 7/1981 | Moertel | 24/397 X |
| 4,353,760 | 10/1982 | Moertel | 24/381 X |

*Primary Examiner*—Philip C. Kannan

*Attorney, Agent, or Firm*—Hill, Van Santen, Steadman & Simpson

[57] ABSTRACT

A slide fastener for use on an object such as a bag of paper or nonwoven fabric has a pair of stringer tapes each having a tape of paper or nonwoven fabric coated on one surface with a film of thermoplastic synthetic resin. Each stringer tape is folded back on itself along a longitudinal fold, providing a folded longitudinal strip with the film facing outwardly. A row of coupling elements is attached, such as by sewing, to each stringer tape along the folded strip. The film reinforces the tape of paper or nonwoven fabric, can easily be bonded to the object upon heating, and provides smooth surfaces for allowing a slider to slide smoothly thereon.

2 Claims, 6 Drawing Figures

SLIDE FASTENER

BACKGROUND OF THE INVENTION

1. Field of the Invention

The present invention relates to a slide fastener for use on a bag, for example, made of paper or nonwoven fabric to open and close an opening in the bag.

2. Description of the Prior Art

Prior slide fasteners for attachment to bags of paper or nonwoven fabric comprise stringer tapes of paper or nonwoven fabric supporting rows of coupling elements directly thereon. When such a slide fastener is subjected to transverse forces tending to pull the stringer tapes laterally apart, the stringer tapes are liable to be torn apart before the rows of coupling elements are disengaged from each other. The slide fastener is usually attached to a paper bag or a nonwoven-fabric bag by stitching the stringer tapes to edges of the bag across an opening therein. Since the stringer tapes are perforated by the sewing needle, however, they become weak in mechanical strength. Another problem with the known slide fasteners having a paper or nonwoven-fabric tape is that it is relatively tedious and time-consuming to attach the slide fastener to a desired object.

SUMMARY OF THE INVENTION

It is an object of the present invention to provide a slide fastener composed of stringer tapes made of paper or nonwoven fabric which are of increased mechanical strength, which can easily be attached to an object such as a bag, and which allow a slider to move smoothly thereon.

According to the present invention, a stringer tape is composed of a tape of paper or nonwoven fabric and a film of thermoplastic synthetic resin coated on one surface of the paper or nonwoven-fabric tape. The stringer tape is folded back on itself along a longitudinal fold, providing a folded longitudinal strip with the film facing outside. A row of coupling elements is sewn to the stringer tape along the folded strip.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
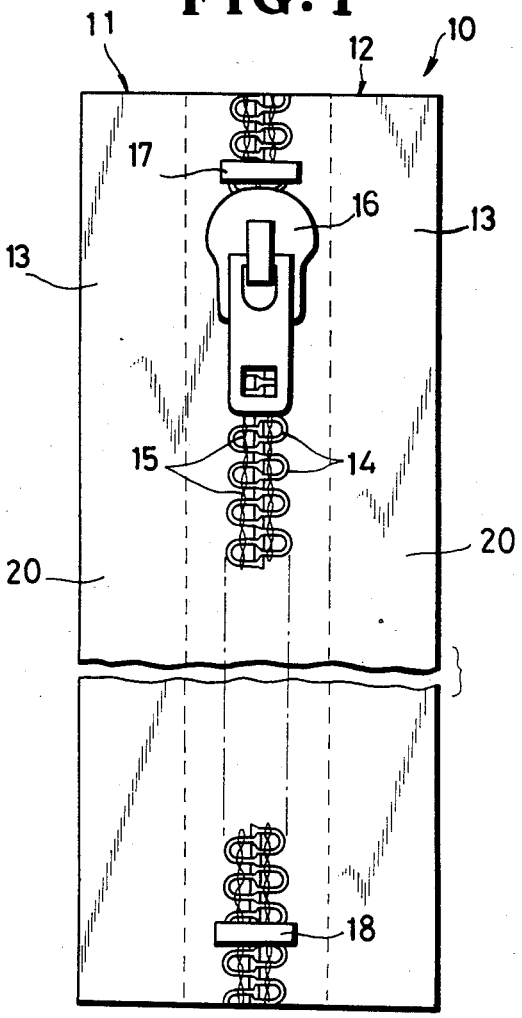
FIG. 1 is a fragmentary plan view of a slide fastener according to the present invention.
Figure 2:
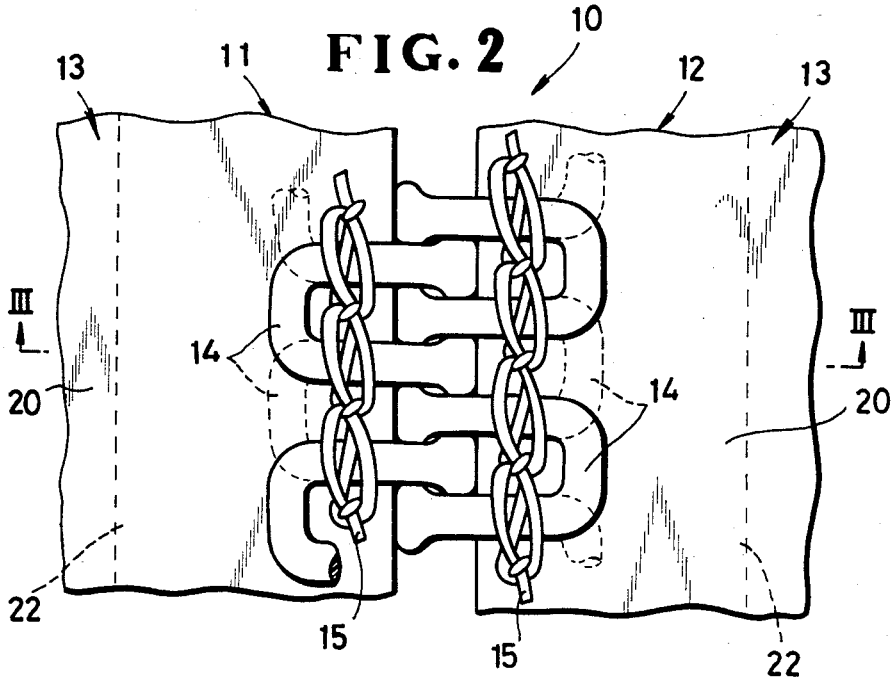
FIG. 2 is an enlarged fragmentary plan view of the slide fastener shown in FIG. 1.

As shown in FIGS. 1 and 2, a slide fastener 10 according to the present invention comprises a pair of slide fastener stringers 11, 12 each having a composite stringer tape 13 supporting a row of coupling elements 14 of the zigzag or meandering type stitched by sewing threads 15 on and along one longitudinal edge of the stringer tape 13.

The two rows of coupling elements 14 can be taken into and out of mutual engagement by a, slider 16 manually movable along the rows of coupling elements 14. The slide fastener 10 also has a pair of top and bottom stops 17, 18 for preventing the slider 15 from running off the rows of coupling elements 14 in fastener opening or closing movement therealong.

Figure 3:
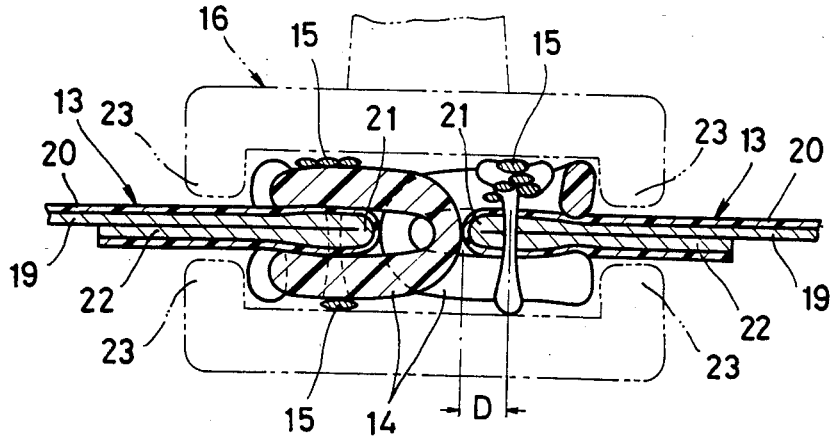
FIG. 3 is a cross-sectional view taken along line III—III of FIG. 2.

As illustrated in FIG. 3, each of the stringer tapes 13 is composed of a tape 19 made of paper or nonwoven fabric and a film 20 of thermoplastic resin bonded or otherwise coated on one surface of the tape 19. The stringer tape 13 is folded back on itself along a longitudinal fold 21, providing a longitudinal underlying strip 22 with the film 20 outwardly. The row of coupling elements 14 is mounted on the folded strip 22 along the fold 21 and sewn thereto by the sewing threads 15. Preferably, the folded strips 22 jointly have a transverse width at least equal to the width of the slider 16 to allow guide flanges 23 thereof to slide smoothly on the film 20 of synthetic resin. The sewing threads 15 on each row of coupling elements 14 have a vertical axis spaced transversely from an inner edge of the fold 21 by a distance D such that the sewing threads 15 are positioned substantially midway transversely between the inner edge of the fold 21 and outer edges of connecting portions of the coupling elements 14. If the distance D were too small or the sewing threads 15 were too close to the inner edge of the fold 21, the coupling elements 14 would be stitched with a reduced strength and become unstable on the stringer tape 13. If the distance D were too large or the sewing threads 15 were too close to the outer edges of the connecting portions of the coupling elements 14, the sewing threads 15 would present an increased resistance to sliding movement of the slider 16 along the coupling elements 14.

The film 20 may be made of modified polyethylene capable of melting at a relatively low temperature to provide adhesive bonding capability. The film 20 can easily be bonded to an object such as a bag of paper or nonwoven fabric by being heated with an iron, for example. The film 20 also serves to reinforce the tape 19, so that the stringer tape 13 has an increased mechanical strength for protection against forces tending to tear apart or otherwise damage the stringer tape 13 during use of the slide fastener 10.

Figure 4:
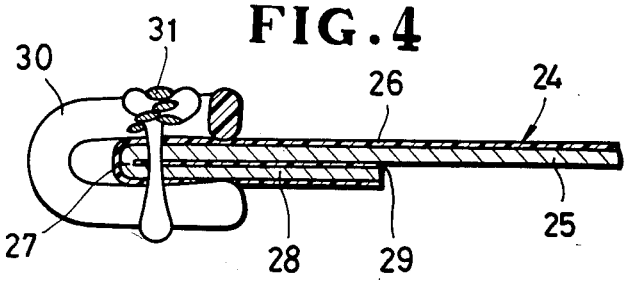
FIGS. 4 through 6 are fragmentary cross-sectional views of slide fasteners according other embodiments of the present invention.

FIG. 4 illustrates a modification in which a stringer tape 24 comprises a tape 25 of paper or nonwoven fabric and a film 26 of thermoplastic synthetic resin coated on one surface thereof. The stringer tape 24 includes a longitudinal strip 28 folded back along a longitudinal fold 27 with the film 26 facing outwardly, there being a film 29 of thermoplastic synthetic resin sandwiched between an unfolded portion of the stringer tape 24 and the folded strip 28. The folded strip 28 can be bonded to the tape 25 by heating the sandwiched strip 29. A row of coupling elements 30 is sewn to the stringer tape 24 by sewing threads 31 along the fold 27. The slide fastener stringer shown in FIG. 4 is particularly advantageous when attached to a bag for containing granular material since the latter cannot enter between the unfolded portion of the stringer tape 24 and the folded strip 28 which are bonded together.

Figure 5:
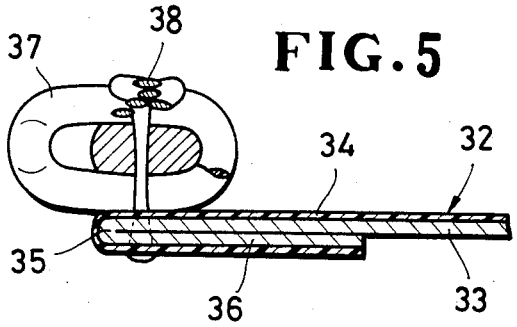

As shown in FIG. 5, a stringer tape 32 is composed of a tape 33 of paper or nonwoven fabric coated on one surface with a film 34 of thermoplastic synthetic resin and is folded on itself along a fold 35 with a folded strip 36 held against an unfolded portion of the tape 33. A row of helically coiled coupling elements 37 is stitched to the stringer tape 32 along the fold 35.

Figure 6:
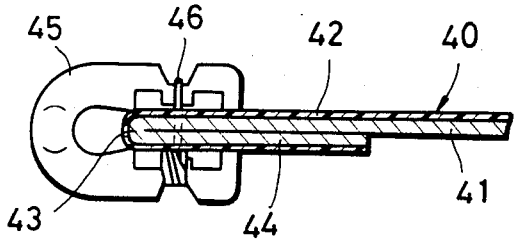

According to a still further embodiment shown in FIG. 6, a stringer tape 40 has a tape 41 of paper or nonwoven fabric with a film 42 of thermoplastic synthetic resin coated on one surface of the tape 41, the stringer tape 40 including a strip 44 folded back along a fold 43. A row of discrete coupling elements 45 is attached to the stringer tape 40 by sewing threads 46 along the fold 43. The coupling elements 45 may be extruded of plastic material or may be in the form of metal die castings.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A slide fastener comprising:

(a) a pair of stringer tapes each including a tape of paper or nonwoven fabric and a first film of thermoplastic synthetic resin and mounted on one surface of said tape, each of said stringer tapes having a folded longitudinal strip with said first thermoplastic resin film facing outwardly;

(b) a pair of rows of coupling elements mounted respectively on said stringer tapes along said folded strips;

(c) a slider movably mounted on said pair of rows of coupling elements and having guide flanges, said thermoplastic resin films being slidably engageable with said guide flanges, said folded strips of the two stringer tapes jointly having a width at least equal to the maximum width of the slider; and (d) a second film of thermoplastic synthetic resin sandwiched between and bonded to said folded strip and an unfolded portion of said stringer tape.

2. A slide fastener according to claim 1, said thermoplastic synthetic resin comprising modified polyethylene capable of melting at a relatively low temperature for adhesive bonding.

* * * * *